US008354965B2

(12) United States Patent
Wu et al.

(10) Patent No.: US 8,354,965 B2
(45) Date of Patent: Jan. 15, 2013

(54) MULTIPLE ANTENNA COMMUNICATION APPARATUS

(75) Inventors: Min Chung Wu, Hsinchu County (TW); Shao Chin Lo, Hsinchu County (TW)

(73) Assignee: Ralink Technology Corporation, Jhubei, Hsinchu County (TW)

( * ) Notice: Subject to any disclaimer, the term of this patent is extended or adjusted under 35 U.S.C. 154(b) by 368 days.

(21) Appl. No.: 12/842,797

(22) Filed: Jul. 23, 2010

(65) Prior Publication Data

US 2011/0043411 A1 Feb. 24, 2011

(30) Foreign Application Priority Data

Aug. 21, 2009 (TW) ..... 98128155 A

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/700 MS, 343/846, 848, 702
See application file for complete search history.

(56) References Cited

U.S. PATENT DOCUMENTS 4,827,271 A * 5/1989 Berneking et al. ..... 343/700 MS
5,124,733 A * 6/1992 Haneishi ..... 343/700 MS
5,262,791 A * 11/1993 Tsuda et al. ..... 343/700 MS
6,836,247 B2 * 12/2004 Soutiaguine et al. .. 343/700 MS

* cited by examiner

*Primary Examiner* — Hoang V Nguyen
(74) *Attorney, Agent, or Firm* — Hamre, Schumann, Mueller & Larson, P.C.

(57) ABSTRACT

A multiple antenna communication apparatus includes a printed circuit board having multiple layers and two antenna devices. The two antenna devices are disposed on antenna regions of the printed circuit board, and each antenna device comprises a ground terminal. Each ground terminal is coupled to a conductor on a different layer of the printed circuit board. The antenna regions on which the two antenna devices are disposed do not contain any main ground via.

18 Claims, 7 Drawing Sheets

MULTIPLE ANTENNA COMMUNICATION APPARATUS

BACKGROUND OF THE INVENTION

1. Field of the Invention

The present invention relates to a wireless communication apparatus, and more particularly, to a multiple antenna communication apparatus.

2. Description of the Related Art

Traditional wireless communication apparatuses use a single antenna at the transmitting end to emit electromagnetic waves for the transmission of communication signals. Traditional wireless communication apparatuses to also use a single antenna at the receiving end to receive the signals carried by the electromagnetic waves. However, with the progress of communication algorithms and manufacturing techniques of integrated circuits, wireless communication apparatuses no longer use a single antenna as the device for transmitting and receiving electromagnetic waves.

Multi-input and multi-output (MIMO) wireless communication apparatuses utilize multiple antennas for transmitting and receiving electromagnetic waves. Exhibiting spatial diversity, MIMO wireless communication apparatuses have higher throughput and longer transmission distance than traditional wireless communication apparatuses without sacrificing transmission bandwidth or increasing power consumption. Due to the features listed above, MIMO wireless communication apparatuses are now used in a majority of all wireless communication systems.

When designing a wireless communication apparatus, it is common to dispose an antenna device at an antenna region of a printed circuit board of a radio frequency (RF) circuit. To evenly distribute ground voltage, traditional RF circuits usually dispose as many main ground vias as possible in the open space of the printed circuit board. FIG. 1 shows a layout of a printed circuit board of a conventional two-antenna communication apparatus 100. As shown in FIG. 1, the conventional two-antenna communication apparatus 100 comprises an RF printed circuit board 110, which includes four layers, and a plurality of main ground vias 140 penetrating the four layers and evenly distributed on the RF printed circuit board 110. The RF printed circuit board 110 comprises a first antenna device 120 and a second antenna device 130. The first antenna device 120 is disposed at an antenna region on the first layer. The second antenna device 130 is disposed at an antenna region on the fourth layer.

Wireless communication apparatuses usually require high radiant efficiency. For MIMO wireless communication apparatuses, isolation degree between antennas significantly affects radiant efficiency. As customers nowadays demand smaller consumer electronic devices, all types of wireless communication apparatuses have to follow the trend such that the distance between antennas disposed on the wireless communication apparatus is reduced. As a result, the isolation degree between such antennas is diminished.

To solve the problem of the reduction of the isolation degree between antennas, it is common to attach an open transmission line between the feed points of two antennas, or to remove a part of the printed circuit board to create a slot between the feed points of two antennas. FIG. 2 shows the attachment of an open transmission line between the feed points of the two antennas 120 and 130 of the two-antenna communication apparatus 100 shown in FIG. 1. As shown in FIG. 2, the first antenna device 120 and the second antenna device 130 are respectively disposed on the left and right sides of the antenna region of the RF printed circuit board 110 to increase the isolation degree between the first antenna device 120 and the second antenna device 130. An open transmission line with length equal to one-fourth the wavelength of the emitted electromagnetic wave of the two-antenna communication apparatus 100 is further attached to the two-antenna communication apparatus 100 between the feed points of the two antennas 120 and 130. As a result, the isolation degree between the first antenna device 120 and the second antenna device 130 is further improved.

FIG. 3 shows the removal of a part of the printed circuit board 110 of the two-antenna communication apparatus 100 shown in FIG. 1. As shown in FIG. 3, the first antenna device 120 and the second antenna device 130 are respectively disposed on the left and right sides of the antenna region of the RF printed circuit board 110 to increase the isolation degree between the first antenna device 120 and the second antenna device 130. A part of the printed circuit board 110 between the feed points of the two antennas 120 and 130 is removed to create a slot with a length of one-fourth the wavelength of the emitted electromagnetic wave of the two-antenna communication apparatus 100. The slot does not contain any device or wire such that the isolation degree between the first antenna device 120 and the second antenna device 130 is further improved.

However, both solutions for improving the isolation degree between antennas provided above require additional board area or manufacture steps. Therefore, these solutions are not suitable when designing a wireless communication apparatus of small size, such as a universal serial bus (USB) device.

FIG. 4 shows a lateral view of the two-antenna communication apparatus 100 shown in FIG. 1. As shown in FIG. 4, the current path between the first antenna device 120 and the second antenna device 130 starts from a ground terminal of the first antenna device 120, passes through a main ground via 140 on the antenna region of the second layer of the printed circuit board 110, further passes through a main ground via 140 on the antenna region of the third layer of the printed circuit board 110, and ends at a ground terminal of the second antenna device 130. As shown in FIG. 4, the current path between the first antenna device 120 and the second antenna device 130 is too short such that the coupling effect between the between the first antenna device 120 and the second antenna device 130 is too large for the first antenna device 120 and the second antenna device 130 to have an acceptable isolation degree.

Therefore, there is a need to design a novel layout structure for a printed circuit board of a multiple antenna communication apparatus such that the isolation degree and the radiant efficiency thereof can be improved without increasing the area of the printed circuit board.

SUMMARY OF THE INVENTION

The multiple antenna communication apparatuses according to the embodiments of the present invention break the convention of designing an RF circuit by reducing ground vias between antennas to increase the current path between antennas. As a result, the coupling effect caused by the feedback ground current is reduced, and the isolation degree and the radiant efficiency of the antennas are improved.

The multiple antenna communication apparatus according to one embodiment of the present invention comprises a board and two antenna devices. The board has multiple layers. The two antenna devices are disposed on antenna regions of the board, wherein each antenna device comprises a ground terminal. Each ground terminal is coupled to a conductor on a different layer of the board.

The multiple antenna communication apparatus according to another embodiment of the present invention comprises a board, a first antenna device and a second antenna device. The board has four layers, and main ground vias are disposed outside antenna regions of the board and penetrate all four layers of the board. The first antenna device is disposed on the top layer. The second antenna device is disposed on the bottom layer. The first antenna device is coupled to a first wire on the layer below the top layer via a first ground terminal, and the first conductor is coupled to a main ground via on the layer below the top layer. The second antenna device is coupled to a second conductor on the layer above the bottom layer via a second ground terminal, and the second conductor is coupled to a main ground via on the layer above the bottom layer.

BRIEF DESCRIPTION OF THE DRAWINGS

The objectives and advantages of the present invention will become apparent upon reading the following description and upon referring to the accompanying drawings of which.

DETAILED DESCRIPTION OF THE INVENTION

Figure 1:
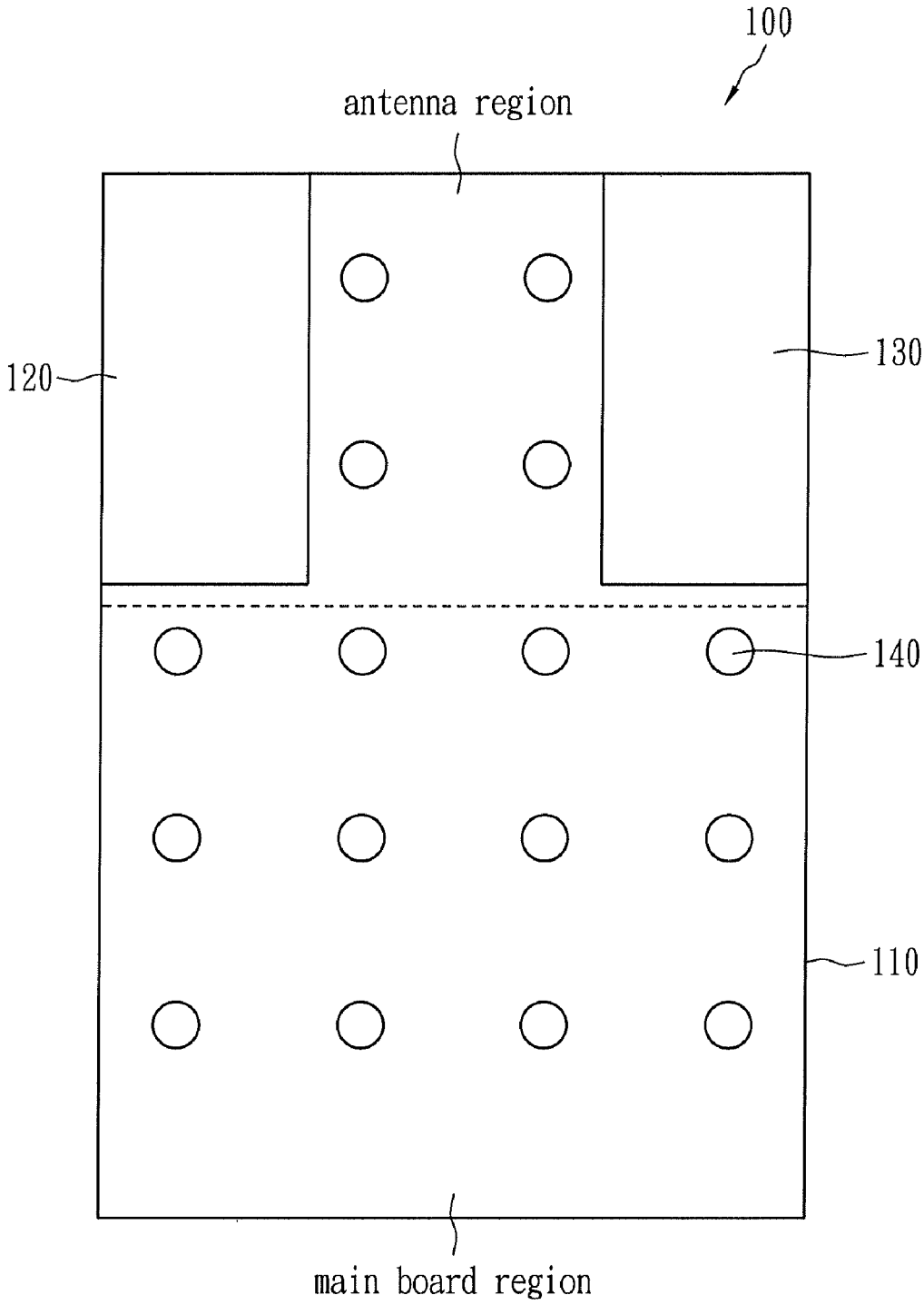
FIG. 1 (Prior Art)
FIG. 1 shows a layout of a printed circuit board of a conventional two-antenna communication apparatus.
Figure 2:
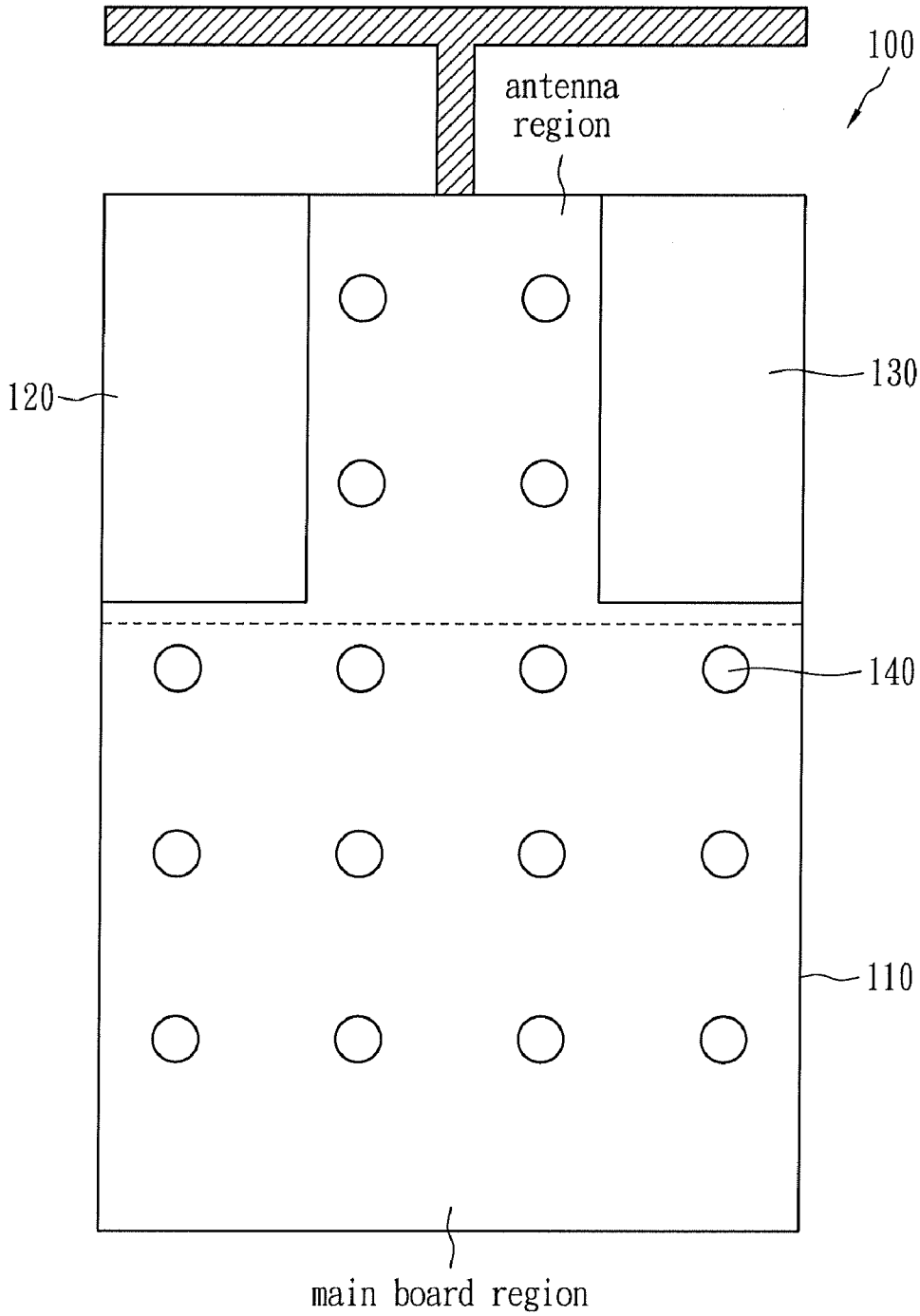
FIG. 2 (Prior Art)
FIG. 2 shows another layout of a printed circuit board of a conventional two-antenna communication apparatus.
Figure 3:
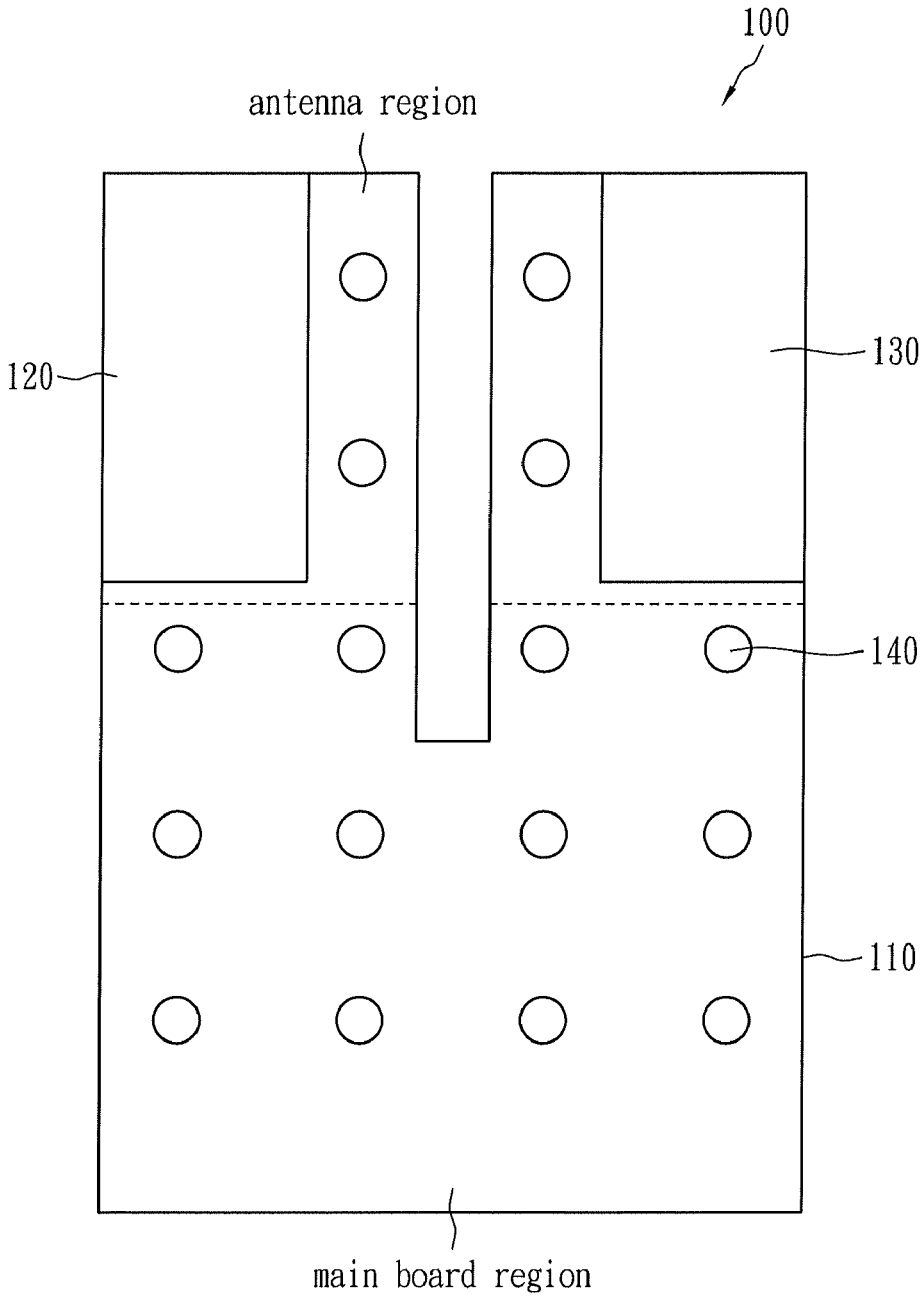
FIG. 3 (Prior Art)
FIG. 3 shows yet another layout of a printed circuit board of a conventional two-antenna communication apparatus.
Figure 4:
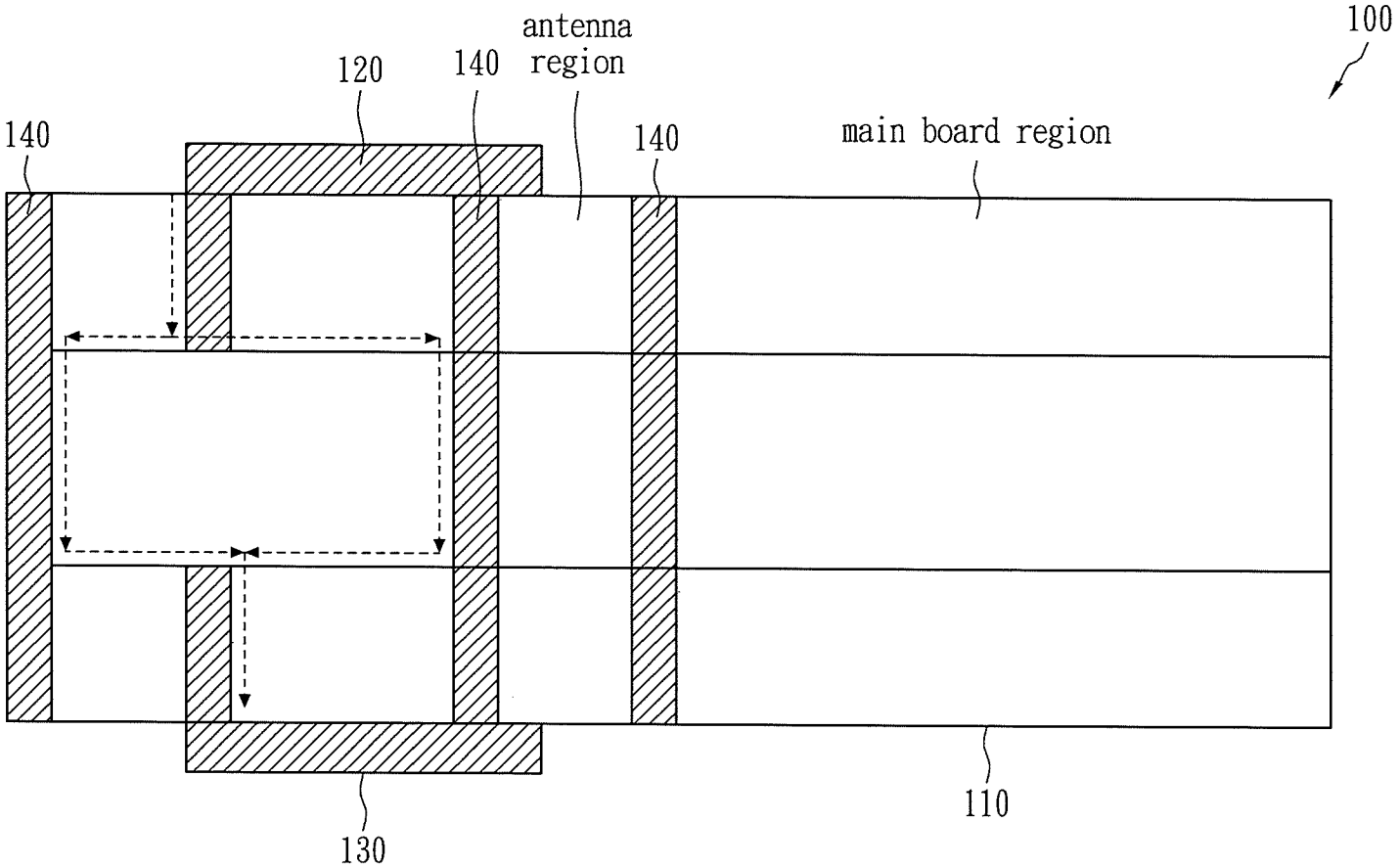
FIG. 4 (Prior Art)
FIG. 4 shows a lateral view of a printed circuit board of a conventional two-antenna communication apparatus.
Figure 5:
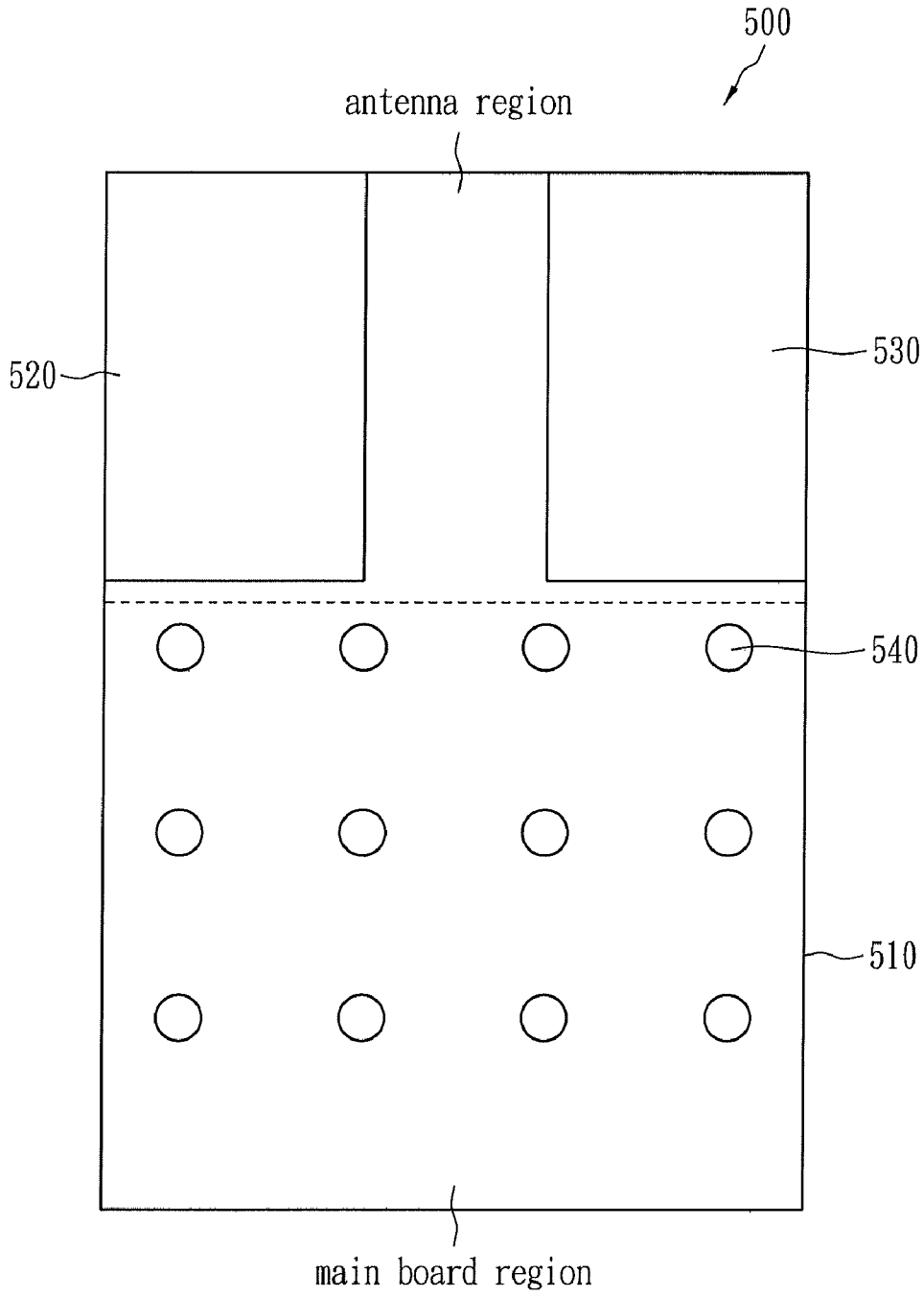
FIG. 5 shows a layout of a multiple antenna communication apparatus according to an embodiment of the present invention.

FIG. 5 shows a layout of a multiple antenna communication apparatus according to an embodiment of the present invention. As shown in FIG. 5, the multiple antenna communication apparatus 500 is a two-antenna communication apparatus. The multiple antenna communication apparatus 500 comprises an RF board 510, which may be a RF printed circuit board, wherein the RF printed circuit board 510 includes four layers. The RF printed circuit board 510 comprises a first antenna device 520 and a second antenna device 530. The first antenna device 520 is disposed at the left side of the antenna region of the first layer of the RF printed circuit board 510. The second antenna device 530 is disposed at the right side of the antenna region of the fourth layer of the RF printed circuit board 510. The first antenna device 520 and the second antenna device 530 are symmetrically arranged in the planar view. The main board region of the RF printed circuit board 510 is disposed of evenly distributed main ground vias 540 penetrating the four layers of the printed circuit board. The antenna region of the RF printed circuit board 510 does not contain any main ground vias.

Figure 6:
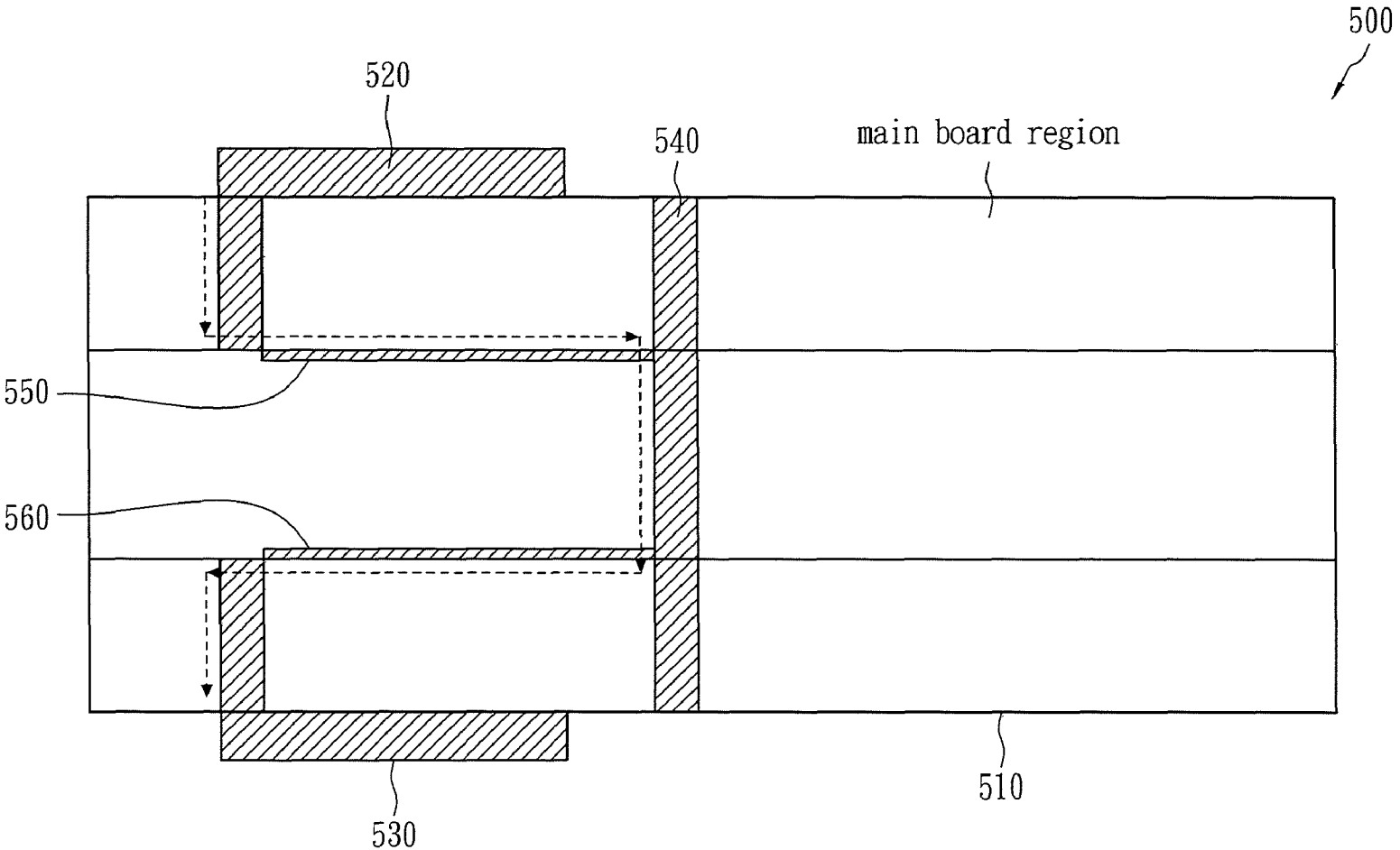
FIG. 6 shows a lateral view of a multiple antenna communication apparatus according to an embodiment of the present invention.

FIG. 6 shows a lateral view of a multiple antenna communication apparatus according to an embodiment of the present invention. As shown in FIG. 6, the first antenna device 520 is disposed at the antenna region of the first layer of the RF printed circuit board 510. The ground terminal of the first antenna device 520 is electrically coupled to the second layer of the RF printed circuit board 510, and then electrically coupled to the main ground via 540 on the main board region of the RF printed circuit board 510 via a conductor 550. The second antenna device 530 is disposed at the antenna region of the fourth layer of the RF printed circuit board 510. The ground terminal of the second antenna device 530 is electrically coupled to the third layer of the RF printed circuit board 510, and then electrically coupled to the main ground via 540 on the main board region of the RF printed circuit board 510 via a conductor 560. As shown in FIG. 6, the current path between the first antenna device 520 and the second antenna device 530 starts from the first antenna device 520 via the ground terminal of the first antenna device 520, passes through the conductor 550 on the second layer of the RF printed circuit board 510, passes through the main ground via 540 on the main board region on the second layer of the RF printed circuit board 510, passes through the main ground via 540 on the main board region on the third layer of the RF printed circuit board 510, passes through the conductor 560 on the third layer of the RF printed circuit board 510, and ends at the second antenna device 530 via the ground terminal of the second antenna device 530.

As shown in FIG. 6, the current path between the first antenna device 520 and the second antenna device 530 is significantly lengthened compared to a conventional wireless communication apparatus. As a result, the isolation degree between the antennas is significantly improved. In some embodiments of the present invention, the length of the current path between the first antenna device 520 and the second antenna device 530 is substantially equal to one-fourth the wavelength of the emitted electromagnetic wave of the multiple antenna communication apparatus 500. It should be noted that even though the first antenna device 520 and the second antenna device 530 are disposed on different layers of the RF printed circuit board 510 as shown in FIG. 6, the multiple antenna communication apparatus provided by the present invention can be implemented in many other ways. For example, the first antenna device 520 and the second antenna device 530 can be disposed on the same layer of the RF printed circuit board 510, and the objective of the present invention can still be achieved. Furthermore, even though the multiple antenna communication apparatus 500 shown in FIG. 5 does not contain any main ground via on the antenna region of the RF printed circuit board 510, the multiple antenna communication apparatus provided by the present invention can be implemented in many other ways. For example, the antenna region of the RF printed circuit board 510 can still be disposed of a few main ground vias such that the distribution density of the main ground vias disposed on the antenna region is lower than the distribution density of the main ground vias disposed on the main board region of the RF printed circuit board 510. As long as the arrangement of the main ground vias can lengthen the current path between the first antenna device 520 and the second antenna device 530 and therefore reduce the coupling effect caused by the feedback ground current of the RF printed circuit board 510, the objective of the present invention is achieved.

Figure 7:
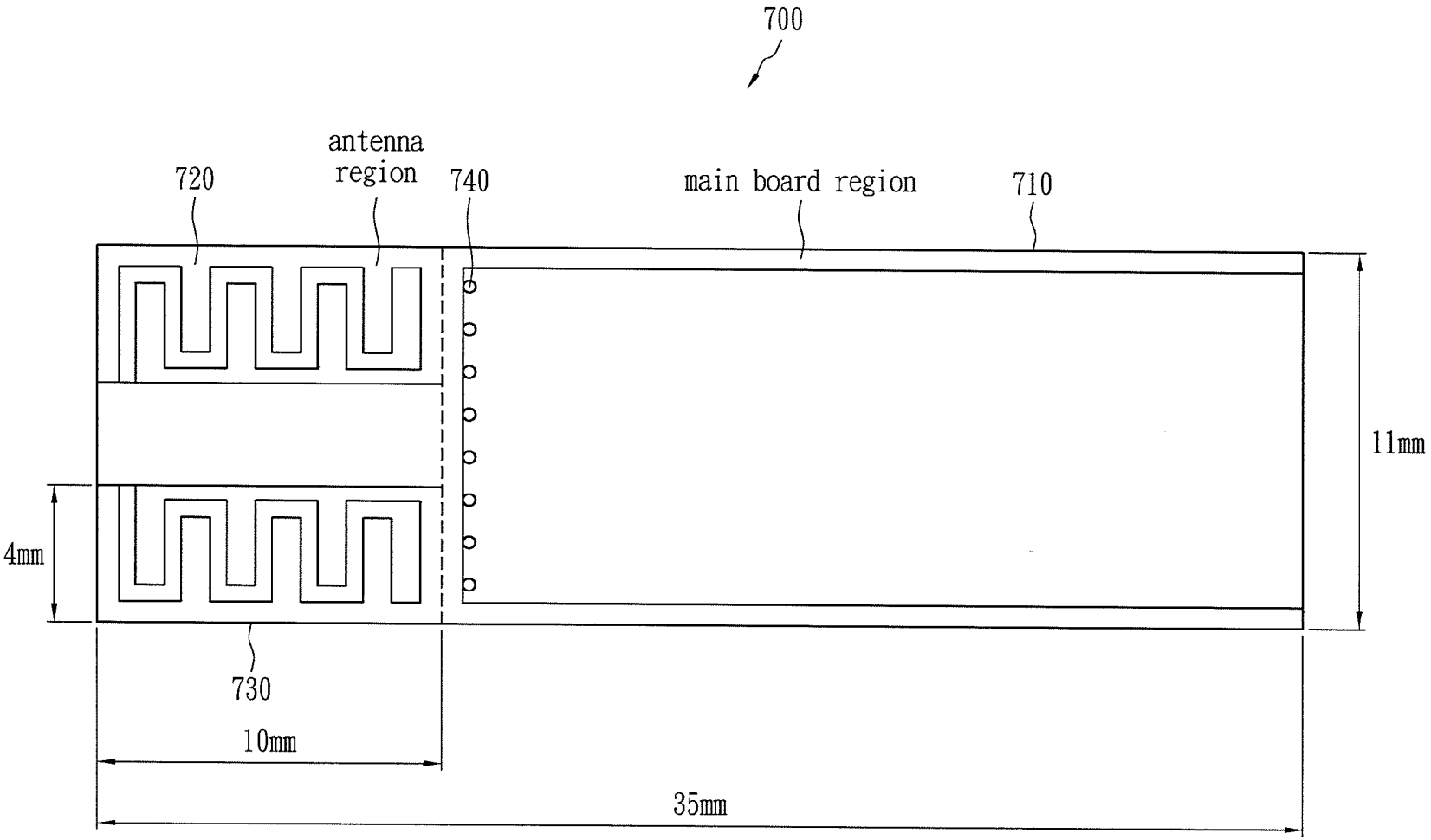
FIG. 7 shows a layout of a multiple antenna communication apparatus according to another embodiment of the present invention.

FIG. 7 shows a layout of a multiple antenna communication apparatus according to another embodiment of the present invention. The multiple antenna communication apparatus 700 is a two-antenna communication apparatus, and is applicable to USB devices. As shown in FIG. 7, the length of the multiple antenna communication apparatus 700 is 35 mm, and the width of the multiple antenna communication apparatus 700 is 11 mm. The multiple antenna communication apparatus 700 comprises an RF printed circuit board 710, a first antenna device 720, a second antenna device 730 and a plurality of main ground vias 740. The RF printed circuit board 710 includes four layers. Both the first antenna device 720 and the second antenna device 730 have a length of 10 mm and a width of 4 mm. The first antenna device 720 and the second antenna device 730 are symmetrically arranged and disposed at the left and right sides of the RF printed circuit board 710 respectively. Both the second layer and the third layer of the RF printed circuit board 710 comprise conductors to electrically couple the ground terminals of the first antenna device 720 and the second antenna device 730 to the main ground vias 740. The total length of the conductors ranges from 8 mm to 12 mm. The multiple antenna communication apparatus 700 shown in FIG. 7 is operable on frequencies ranging from 2.4 GHz to 2.5 GHz.

According to simulation results, when operating at frequencies between 2.4 GHz and 2.5 GHz, the return loss S11 of the multiple antenna communication apparatus 700 shown in FIG. 7 is about −10 dB, and thus the multiple antenna communication apparatus 700 meets the requirement for an ordinary antenna design. As for the isolation degree S21 of the multiple antenna communication apparatus 700, the multiple antenna communication apparatus 700 has improved more than 1 dB when operating at frequencies between 2.4 GHz and 2.5 GHz compared to conventional multiple antenna communication apparatuses of the same size. The multiple antenna communication apparatus 700 also has improved gain compared to conventional multiple antenna communication apparatuses of the same size.

In conclusion, the multiple antenna communication apparatus according to the embodiments of the present invention breaks with conventional rules of designing an RF circuit by reducing ground vias between antennas to increase the current path between antennas. As a result, the coupling effect caused by the feedback ground current is reduced, and thus the isolation degree of the antennas are significantly improved without increasing the area of the printed circuit board.

The above-described embodiments of the present invention are intended to be illustrative only. Those skilled in the art may devise numerous alternative embodiments without departing from the scope of the following claims.

What is claimed is:

1. A multiple antenna communication apparatus, comprising:

a board having multiple layers; and two antenna devices disposed on antenna regions of the board, wherein each antenna device comprises a ground terminal;

wherein each ground terminal is electrically coupled to a different layer of the board.

2. The multiple antenna communication apparatus of claim 1, wherein the antenna regions on which the two antenna devices are disposed do not contain any main ground via.

3. The multiple antenna communication apparatus of claim 1, wherein there is at least one main ground via disposed on the antenna regions on which the two antenna devices disposed, and the distribution density of the at least one main ground via disposed on the antenna regions is lower than the distribution density of main ground vias disposed on main board regions of the board.

4. The multiple antenna communication apparatus of claim 1, further comprising:

at least one antenna device disposed on the antenna regions of the board, wherein each of the at least one antenna device comprises a ground terminal coupled to a conductor on a different layer of the board;

wherein the current path between any two of the antenna devices starts from a ground terminal of one antenna device, passes through a main ground via on a different layer of the board, and ends at a ground terminal of the other antenna device.

5. The multiple antenna communication apparatus of claim 4, wherein the length of the current path is substantially equal to one-fourth the wavelength of the emitted electromagnetic wave of the multiple antenna communication apparatus.

6. The multiple antenna communication apparatus of claim 1, wherein all of the antenna devices are disposed on the same layer of the board.

7. The multiple antenna communication apparatus of claim 1, wherein each of the antenna devices is disposed on a different layer of the board.

8. The multiple antenna communication apparatus of claim 1, wherein the antenna devices are symmetrically disposed on left and right sides of the antenna regions of the board.

9. The multiple antenna communication apparatus of claim 1, which is applicable to universal serial bus devices.

10. The multiple antenna communication apparatus of claim 1, which is operable on frequencies ranging from 2.4 GHz to 2.5 GHz.

11. A multiple antenna communication apparatus, comprising:

a board having four layers and main ground vias, the main ground vias being disposed outside antenna regions of the board and penetrating all four layers of the board;

a first antenna device disposed on the top layer; and a second antenna device disposed on the bottom layer;

wherein the first antenna device is coupled to a first conductor on the layer below the top layer via a first ground terminal, and the first conductor is coupled to a main ground via on the layer below the top layer;

wherein the second antenna device is coupled to a second conductor on the layer above the bottom layer via a second ground terminal, and the second conductor is coupled to a main ground via on the layer above the bottom layer.

12. The multiple antenna communication apparatus of claim 11, wherein the total length of the first conductor and the second conductor is substantially equal to one-fourth the wavelength of the emitted electromagnetic wave of the multiple antenna communication apparatus.

13. The multiple antenna communication apparatus of claim 11, wherein the first antenna device and the second antenna device are symmetrically disposed on left and right sides of the antenna regions of the board, respectively.

14. The multiple antenna communication apparatus of claim 11, which is applicable to universal serial bus devices.

15. The multiple antenna communication apparatus of claim 11, which has a length of about 35 mm and a width of about 11 mm.

16. The multiple antenna communication apparatus of claim 11, wherein both the first antenna device and the second antenna device have a length of about 10 mm and a width of about 4 mm.

17. The multiple antenna communication apparatus of claim 11, wherein the total length of the first conductor and the second conductor ranges from 8 mm to 12 mm.

18. The multiple antenna communication apparatus of claim 11, which is operable on frequencies ranging from 2.4 GHz to 2.5 GHz.

* * * * *